US010505281B2

(12) United States Patent
Brigham

(10) Patent No.: US 10,505,281 B2
(45) Date of Patent: Dec. 10, 2019

(54) COINCIDENT PHASE CENTERED FLARED NOTCH FEED

(71) Applicant: Massachusetts Institute of Technology, Cambridge, MA (US)

(72) Inventor: Glenn A. Brigham, Chelmsford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/948,355

(22) Filed: Apr. 9, 2018

(65) Prior Publication Data

US 2019/0312355 A1 Oct. 10, 2019

(51) Int. Cl.

| | |
|---|---|
| ***H01Q 13/08*** | (2006.01) |
| ***H01Q 13/10*** | (2006.01) |
| ***H01P 5/10*** | (2006.01) |
| ***H01Q 5/55*** | (2015.01) |
| ***H01Q 5/45*** | (2015.01) |

(52) U.S. Cl.

CPC ..... *H01Q 13/085* (2013.01); *H01P 5/1007* (2013.01); *H01Q 5/45* (2015.01); *H01Q 5/55* (2015.01); *H01Q 13/106* (2013.01)

(58) Field of Classification Search

CPC .. H01Q 21/064; H01Q 21/26; H01Q 21/0087; H01Q 13/10; H01Q 13/0085

See application file for complete search history.

(56) References Cited

U.S. PATENT DOCUMENTS

| | | | | |
|---|---|---|---|---|
| 4,740,795 | A | 4/1988 | Seavey | |
| 7,180,457 | B2 * | 2/2007 | Trott | H01Q 13/085 343/770 |
| 7,948,332 | B2 | 5/2011 | Trott et al. | |
| 8,325,099 | B2 | 12/2012 | Cavener et al. | |
| 8,350,773 | B1 | 1/2013 | Kindt | |
| 8,736,504 | B1 | 5/2014 | West et al. | |
| 9,614,290 | B1 | 4/2017 | Remski | |
| 2006/0038732 | A1 * | 2/2006 | DeLuca | H01Q 13/085 343/754 |
| 2011/0148725 | A1 | 6/2011 | Cavener et al. | |
| 2015/0077300 | A1 | 3/2015 | Wang et al. | |
| 2017/0162950 | A1 | 6/2017 | Little et al. | |

OTHER PUBLICATIONS

International Search Report and Written Opinion dated Jan. 4, 2019 in corresponding PCT application No. PCT/US18/26788.

(Continued)

*Primary Examiner* — Hoang V Nguyen

(74) *Attorney, Agent, or Firm* — Nields, Lemack & Frame, LLC

(57) ABSTRACT

A coincident phase centered antenna and a mechanism for feeding electrical signals to the antenna is disclosed. Each of the four prongs is fed by a respective conductor. Each respective conductor is in electrical communication with a connector or trace located on the bottom surface of the base or supporting printed circuit board. This configuration allows independent signals to be supplied to each of the four prongs in the coincident phase centered antenna. In some embodiments, the prongs are mounted on a metal base. In other embodiments, the prongs are mounted on a printed circuit board.

20 Claims, 7 Drawing Sheets

(56) References Cited

OTHER PUBLICATIONS

Choung, "Wideband Double-Slot Cross-Notch Antenna", TRW Space & Electronics Group, pp. 448-451, 2001.
McGrath, "Wideband Arrays and Polarization Synthesis", Raytheon Company, 5 pages, 2016.
Pickles et al., "Coincident Phase Center Ultra Wideband Array of Dual Polarized Flared Notch Elements", Naval Research Laboratory, Radar Division, SFA, Inc., pp. 4421-4424, 2007.
Rao et al., "Some Recent Advances in Wideband Phased Arrays", Naval Research Laboratory, Radar Division, 3 pages, 2002.
Trott et al., "7-21 GHz Wideband Phased Array Radiator", Raytheon Company, pp. 2265-2268, 2004.
"High Band Technology Program (HiTeP) Final Report", Raytheon Company, 37 pages, Mar. 1, 2005.

* cited by examiner

COINCIDENT PHASE CENTERED FLARED NOTCH FEED

This invention was made with Government support under Grant No. FA8702-15-D-0001 awarded by the U.S. Air Force. The Government has certain rights in the invention.

FIELD

This disclosure relates to coincident phase centered flared notch antennas, and more particularly to the connection system for such an antenna.

BACKGROUND

Antenna arrays are used for a variety of different applications. Antenna arrays may be constructed using a plurality of three-dimensional (3D) antennas. These arrays are typically configured as a rectangular lattice but other geometries are also possible. Additionally, these antennas may be used separately, and not as part of an array. In certain embodiments, the 3D antennas may comprise notch antenna elements. The term "notch antenna" is intended to include tapered and flared elements, such that the shape is not limited by this disclosure.

Each notch antenna element includes an electrically conductive body, referred to as a notch radiator element, which has a vertical gap. The vertical gap separates the notch radiator element into two prongs. Each of the prongs are energized with signals with unequal phases. In general, the energized prongs convey energy from a feed port into free space or air, or visa-versa. The feed ports may have a characteristic impedance relative to the system impedance for maximum power transfer. The propagating signal leaving the feed ports is in communication with the prongs where electrical energy is emitted into the tuned vertical gap between the two prongs. This gap is optimized with other dimensions to result in optimal performance over the designed frequency band and scan volume (array). The vertical gap conveys the propagating signal to free space or air. The antenna feed port may convey energy to and from the antenna system at its characteristic impedance.

A coincident phase centered (CPC) antenna has two such notch antennas that share a common vertical gap. Often, the notch antennas are oriented perpendicular to one another. These may be referred to as horizontally and vertically polarized antennas. These CPC antennas can be used in a variety of applications. For example, in one embodiment, only the notch antennas oriented in one direction, such as the horizontally polarized antennas, are utilized. In another embodiment, the two sets of notch antennas are used, however they are not deployed simultaneously. In yet other embodiments, the two sets of the notch antennas have been used simultaneously.

Wideband CPC antennas are used in a variety of applications. Their complex architecture makes them relatively costly to build since the quintessential CPC is formatted in a brick architecture.

Therefore, it would be beneficial if there were a coincident phase centered antenna that was more cost efficient to implement, with greater flexibility in design while retaining full functionality of the CPC antenna.

SUMMARY

A coincident phase centered antenna and a mechanism for feeding electrical signals to the antenna is disclosed. Each of the four prongs is fed by a respective conductor. Each respective conductor is in electrical communication with a connector or trace located on the bottom surface of the base or supporting printed circuit board. This configuration allows independent signals to be supplied to each of the four prongs in the coincident phase centered antenna. In some embodiments, the prongs are mounted on a metal base. In other embodiments, the prongs are mounted on a printed circuit board. In some embodiments, the design creates a lower profile feed architecture within a PCB and optionally allows for an expanded feed network using standard PCB processing techniques. In certain embodiments, the design integrates this PCB architecture independently or with direct connection components to a 3D antenna. Optionally, this design can be integrated with a backplane feed or beamformer network transitioning from tile back to a brick architecture.

BRIEF DESCRIPTION OF THE DRAWINGS

For a better understanding of the present disclosure, reference is made to the accompanying drawings, which are incorporated herein by reference and in which.

DETAILED DESCRIPTION

The present disclosure describes a coincident phase centered antenna and the connection mechanism for such an antenna.

Figure 1A:
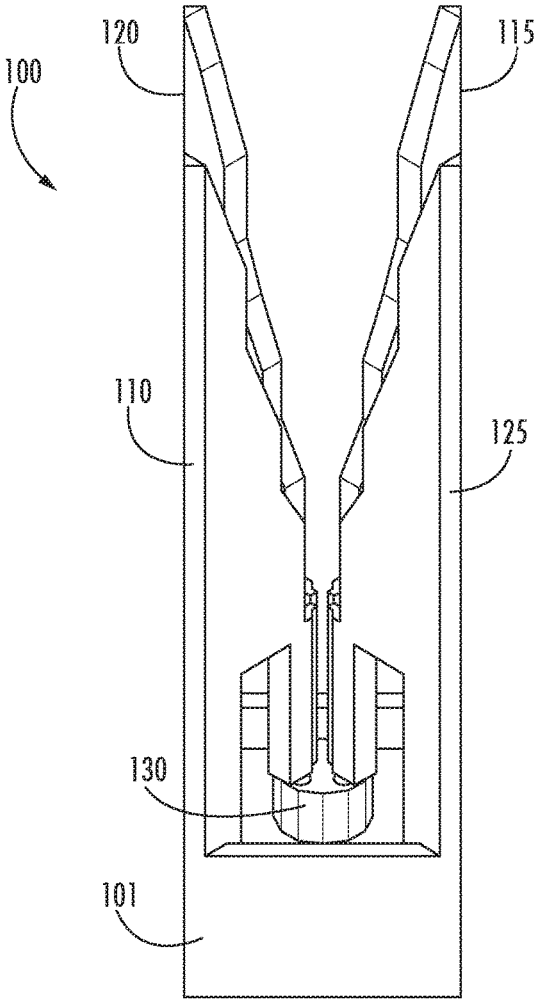
FIG. 1A shows a perspective view of a coincident phase centered antenna according to one embodiment.

FIG. 1A shows the coincident phase centered antenna 100 according to one embodiment.

Figure 1B:
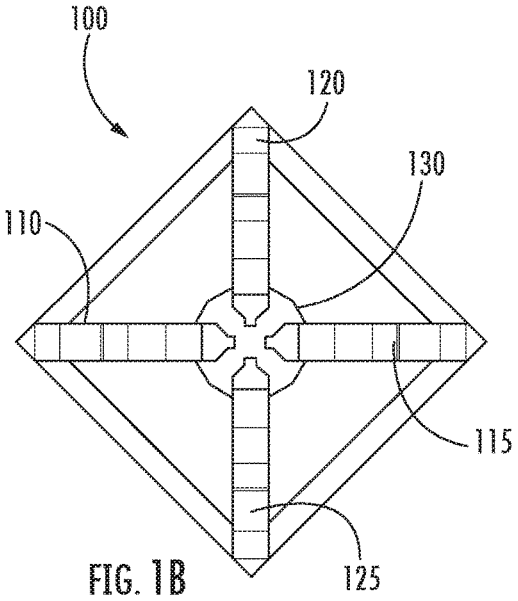
FIG. 1B shows a top view of the CPC antenna of FIG. 1A.
Figure 1C:
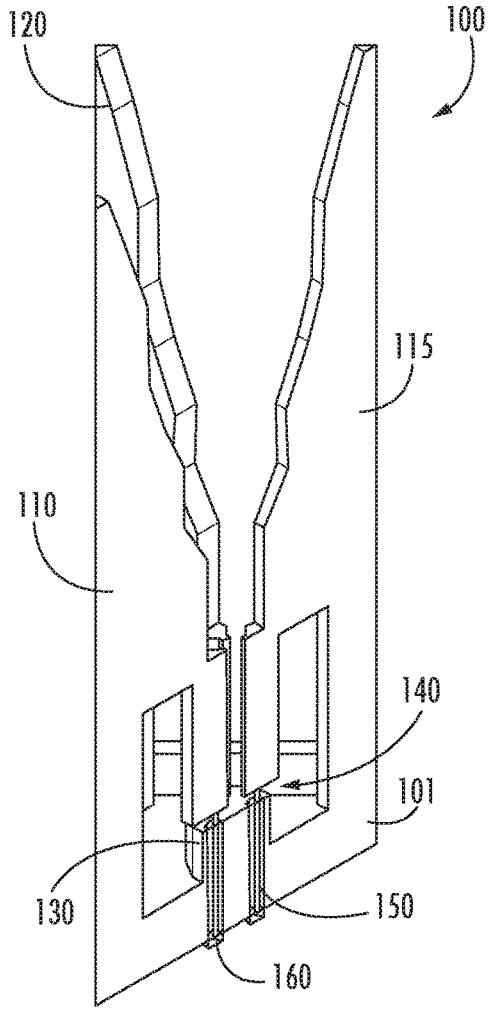
FIG. 1C shows a cross-section of the CPC antenna of FIG. 1A.

The coincident phase centered (CPC) antenna 100 includes a base 101, from which four prongs extend upward in the height direction. The base 101 and the prongs may be constructed from a metal or another electrically conductive material, such as, for example, material from an additive manufacturing process. The base 101 is electrically connected to ground. The four prongs are configured as a set of two horizontally polarized prongs 110, 115 and a set of two vertically polarized prongs 120, 125. Each prong has a supported end, where it attaches to the base 101, and a free end, which is suspended above the base 101. The two horizontally polarized prongs 110, 115 are separated by a vertical gap. Similarly, the two vertically polarized prongs 120, 125 are also separated by a vertical gap. The midlines of these two vertical gaps is coincident, as best shown in FIG. 1B.

Figure 1D:
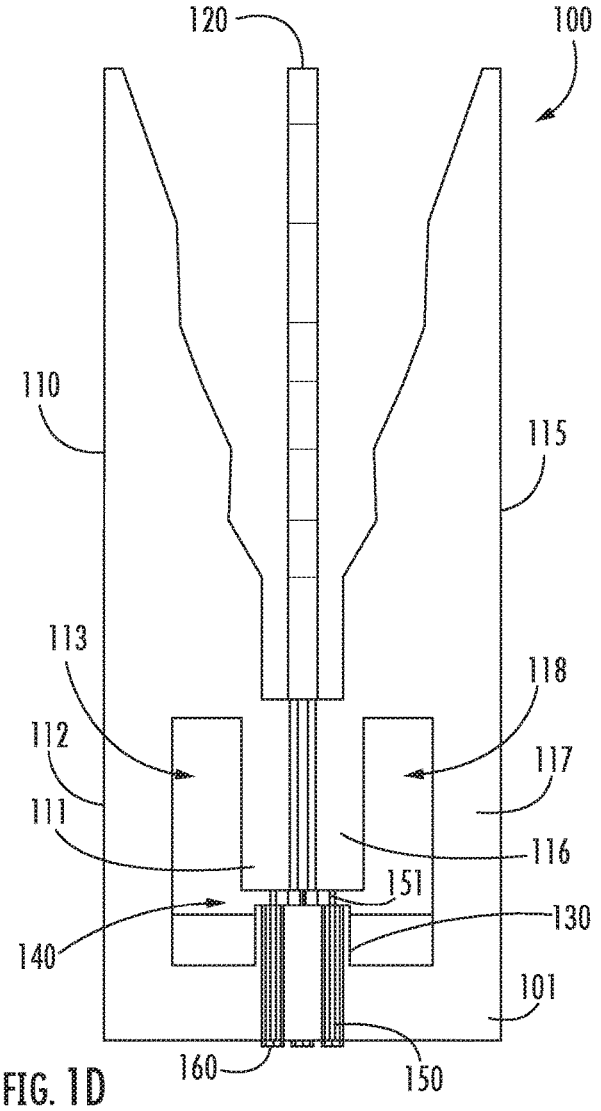
FIG. 1D shows a front view of the cross-section of FIG. 1C.

A metal pedestal 130 extends upward from the base 101. The metal pedestal 130 is positioned in the center of the base 101 and is configured such that the free ends of each prong are disposed directly above the metal pedestal 130. FIG. 1D shows horizontally polarized prongs 110, 115, each with a free end 111, 116 and a supported end 112, 117, respectively. The vertically polarized prongs 120, 125 are similarly configured.

The prongs may be configured such that there may be a tuning cavity that is disposed between the free end and the supported end. For example, FIG. 1D shows tuning cavities 113, 118 disposed between the free ends 111, 116 and the supported ends 112, 117, respectively. These features are also present for the vertically polarized prongs 120, 125. However, in other embodiments, the tuning cavities may not be present depending on tuning requirements and associated geometries.

A horizontal gap 140 is formed between the upper surface of the metal pedestal 130 and the lower portions of each of the free ends of the four prongs. This horizontal gap 140 separates the metal pedestal 130 from the free ends of the prongs. In this way, the metal pedestal 130 is not mechanically connected to the free ends of the prongs.

As best seen in FIG. 1D, electrical feeds, such as coaxial transmission lines 150, each having a center conductor 151, pass through a respective bore in the metal pedestal 130 and the base 101, and enter the free end of a respective prong. The center conductor 151 of the coaxial transmission line 150 is sized such that it does not contact the interior walls of the bore. In other words, the center conductor 151 of the coaxial transmission line 150 is smaller in diameter than the inner diameter of the bore in the metal pedestal 130. In certain embodiments, the center conductor 151 of the coaxial transmission line 150 is separated from the interior walls of the bore by air. In other embodiments, a dielectric material may be disposed around the center conductor 151 of the coaxial transmission line 150 to ensure that it is electrically insulated from the interior walls of the bore. The distal end of the center conductor 151 of the coaxial transmission line 150 enters a portion of the free end of the respective prong. This portion of the free end of the prong may be referred to as the energization region. In one embodiment, the center conductor 151 of the coaxial transmission line 150 is threaded and is screwed into the energization region, which may also be threaded in this embodiment. In another embodiment, the center conductor 151 of the coaxial transmission line 150 is press-fit, soldered, welded, or otherwise affixed into the energization region. While a coaxial transmission line 150 is described, other means for carrying the signal, which may be an electrical signal, an electromagnetic signal or an RF signal, through the base 101 and the metal pedestal 130 to the energization region of the prong may be used.

The proximal end of the center conductor 151 of the coaxial transmission line 150 may, in certain embodiments, pass through, connect, interface or transition to a PC board (not shown) and terminate in a feed port. In other embodiments, the feed port 160 may be disposed on the base 101.

Therefore, there are four feed ports 160 associated with each CPC antenna 100. Each of these feed ports 160 is in communication with a respective electrical signal and a respective center conductor 151. Thus, each feed port 160 supplies an electrical signal to exactly one energization region of a corresponding prong. Consequently, polarization flexibility is achieved by implementing the CPC techniques shown in FIGS. 1A-1D. For example, a first signal may be supplied to the feed port 160 associated with horizontally polarized prong 110, and the same first signal, offset by 180°, is supplied the feed port 160 associated with horizontally polarized prong 115. Similarly, a second signal may be supplied to the feed port 160 associated with vertically polarized prong 120, and the same second signal, offset by 180°, is supplied the feed port 160 associated with vertically polarized prong 125. In some embodiments, the second signal is the same as the first signal, or may be the first signal with a phase offset. In other words, the four prongs may be energized in a variety of ways. Table 1 shows some of the possible configurations. The values indicate the phase associated with each prong.

TABLE 1

| Embodiment | Prong 110 | Prong 120 | Prong 115 | Prong 125 |
|---|---|---|---|---|
| 1 | 0 | 0 | 180 | 180 |
| 2 | 0 | 180 | 180 | 0 |
| 3 | 0 | 90 | 180 | 270 |
| 4 | 0 | 270 | 180 | 90 |

In certain embodiments, the length of each center conductor 151 between the energization region and the associated feed port 160 is the same. In this way, no polarization distortion is introduced by the CPC antenna 100.

In certain embodiments, the metal pedestal 130 may be used to provide mechanical support for the coaxial transmission lines 150 that extend through the base 101 and the metal pedestal 130. The metal pedestal 130 may also provide the outer conductor for the center conductors 151 of the coaxial transmission line 150, to retain coaxial transmission line characteristics.

Figure 2A:
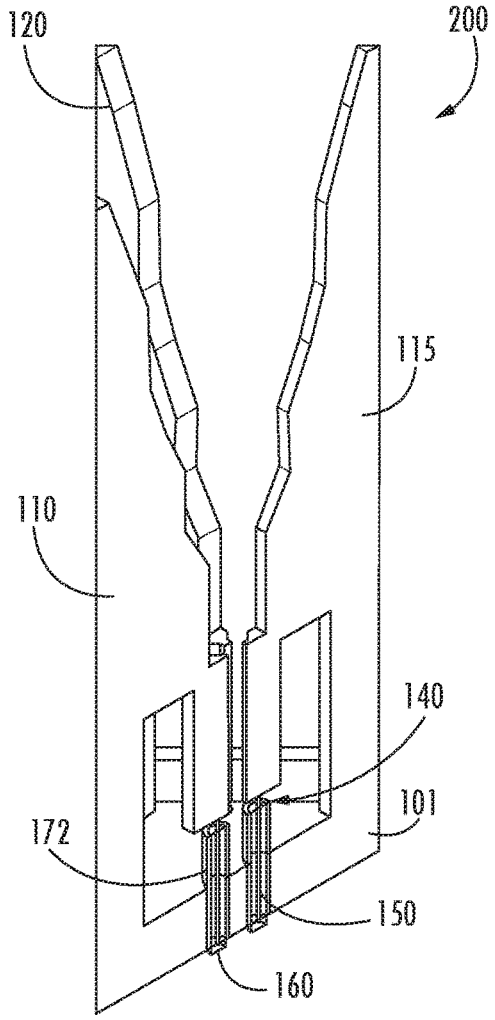
FIG. 2A shows a perspective view of a coincident phase centered antenna according to another embodiment.
Figure 2B:
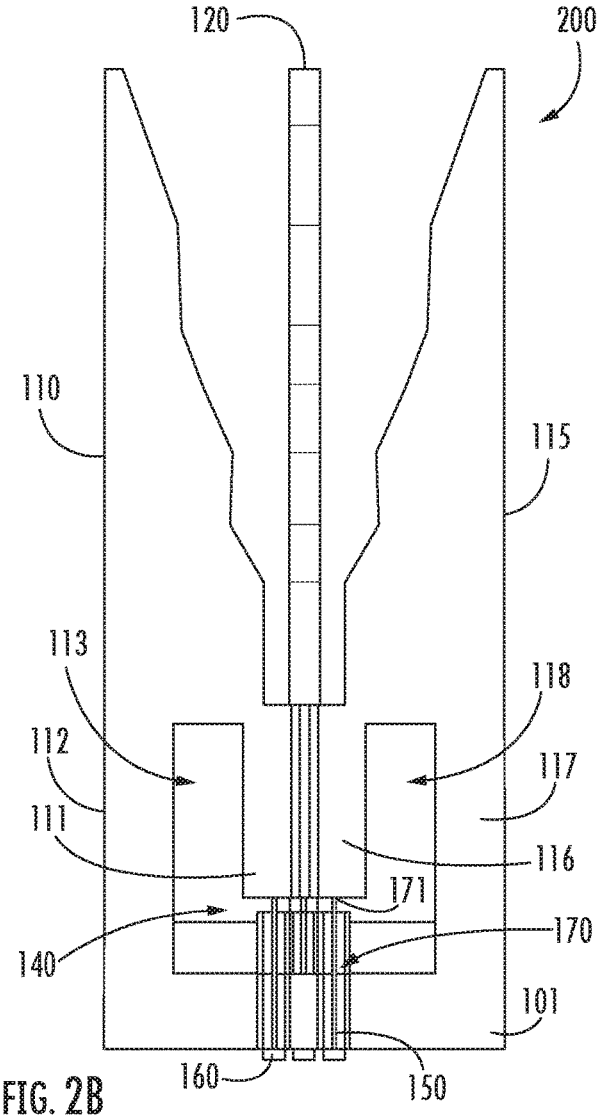
FIG. 2B shows a cross-section of the CPC antenna of FIG. 2A.

In another embodiment, the metal pedestal 130 may not be employed. FIGS. 2A-2B show a CPC antenna 200, similar to the CPC antenna 100 of FIGS. 1A-1D, where the metal pedestal 130 is not used. Components that are identical to those in CPC antenna 100 are given identical reference designators.

In this embodiment shown in FIGS. 2A-2B, a sleeved coaxial line feed 170 extends upward from the feed port 160 toward the energization region of each prong. The sleeve 172 of the sleeved coaxial line feed 170 may be electrically conductive and may be grounded in certain embodiments. In certain embodiments, the sleeve 172 may be metal. The sleeve 172 terminates prior to contacting the lower surface of the free end of the respective prong. The center conductor 171 of the sleeved coaxial line feed 170 is sized such that it does not contact the exterior walls of the sleeved coaxial line feed 170. In other words, the center conductor 171 of the sleeved coaxial line feed 170 is smaller in diameter than the inner diameter of the sleeve 172 of the sleeved coaxial line feed 170. In certain embodiments, the center conductor 171 of the sleeved coaxial line feed 170 is separated from the interior walls of the sleeve 172 by air. In other embodiments, a dielectric material may be disposed around the center conductor 171 of the sleeved coaxial line feed 170 to ensure that it is electrically insulated from the interior walls of the sleeve 172. The distal end of the center conductor 171 of the sleeved coaxial line feed 170 enters the energization region of the respective prong. In one embodiment, the center conductor 171 of the sleeved coaxial line feed 170 is threaded and is screwed into the energization region, which may also be threaded in this embodiment. In another embodiment, the center conductor 171 of the sleeved coaxial line feed 170 is press-fit, soldered, welded, or otherwise affixed into the energization region. While a sleeved coaxial line feed 170 is described, other means for carrying the electrical, electromagnetic or RF signal through the base 101 and the metal pedestal 130 to the energization region of the prong may be used. For example, in certain embodiments, the center conductor 171 may not be covered by a sleeve 172.

In the embodiments described above, the prongs extend upward from a conductive base. Four feed ports are disposed on the bottom surface of the base. These four feed ports are each in communication with a center conductor that passes through the base and electrically connects the feed port with a respective energization region of a prong. In this way, four different signals may be supplied to each of the four prongs in the CPC antenna. Of course, less than four different signals may be supplied. For example, the same signal may be supplied to one of the prongs. While FIGS. 1A-1D and 2A-2B show the center conductors being vertically oriented, it is understood that the center conductors may take other paths through the base.

In some embodiments, a printed circuit board (PCB) may be used. In these embodiments, the antenna is a 3D structure, which may be machined, formed or created using additive manufacturing, and is bonded or otherwise mechanically affixed to the patterned top metal layer of the PCB using one of a variety of suitable methods.

In all of the embodiments that utilize a PCB, shown in FIGS. 3-7, the top metal layer of the PCB has a pattern formed in the geometry of the 3D structure base that forms the CPC antenna footprint. This pattern allows electrical connections to the energization regions as well as the necessary grounding regions through the bonding material. The metal pattern will be disposed under the supported ends of the prongs, but may not be disposed between the energization regions.

In addition, each signal via includes a via pad. This via pad is embedded into the footprint geometry, although may not be fully visible.

Figure 3A:
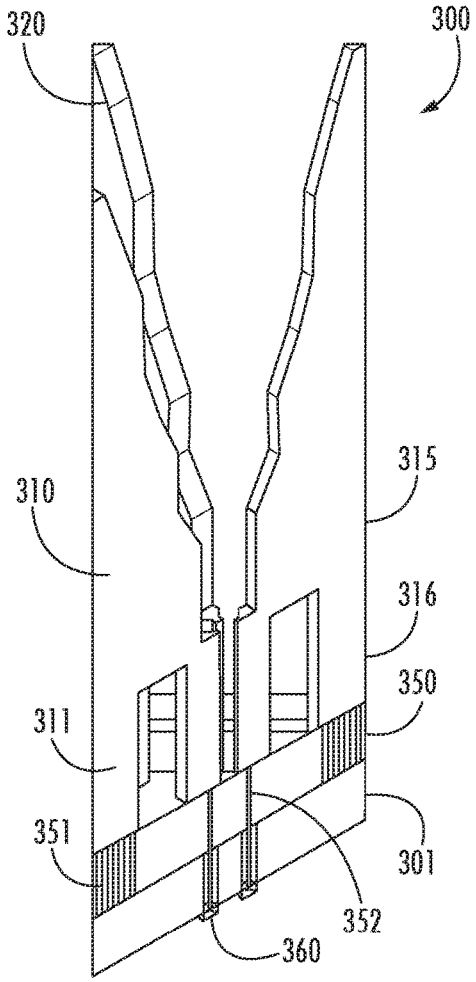
FIG. 3A shows a perspective view of a coincident phase centered antenna that uses a printed circuit board according to one embodiment.
Figure 3B:
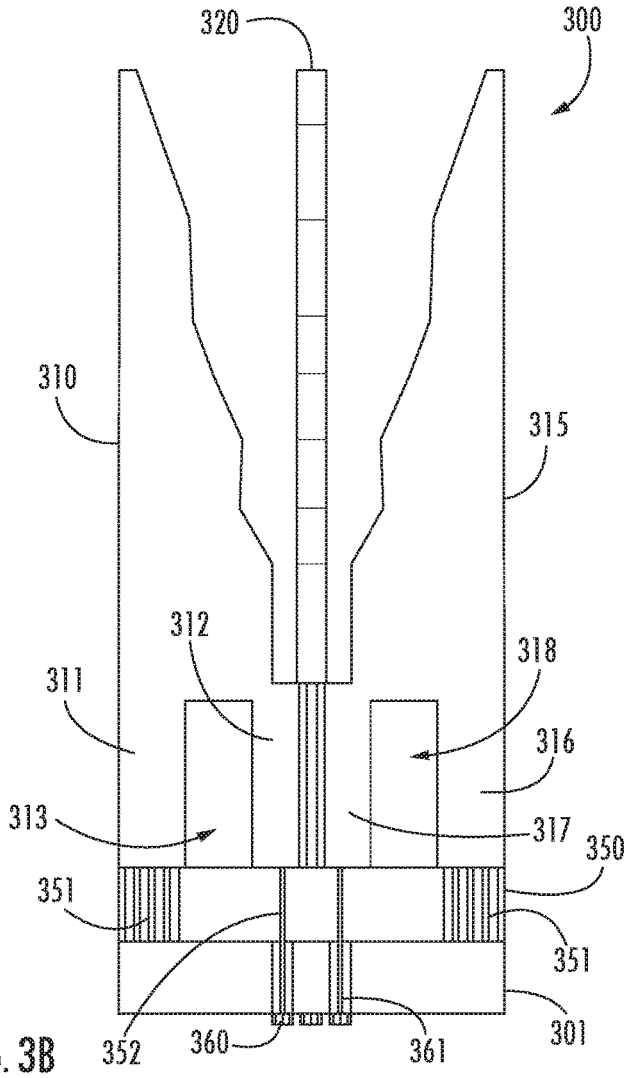
FIG. 3B shows a cross-section of the CPC antenna of FIG. 3A.

FIGS. 3A-3B show an embodiment that utilizes a PCB. In this embodiment, the CPC antenna 300 comprises a base 301 with four feed ports 360. A PCB 350 may be disposed between the base 301 and the prongs. FIGS. 3A-3B show two horizontally polarized prongs 310, 315 and one vertically polarized prong 320. The second vertically polarized prong is not shown in the figures. Each prong has two parts; the supported end distal from the vertical gap, such as supported ends 311, 316 and the energized region, proximal to the vertical gap, such as energized regions 312, 317. In this embodiment, the supported end and the energized region both rest on the PCB 350. In fact, the supported end and the energized region are bonded or mechanically affixed to the PCB 350. Electrical signals also pass through the PCB 350 at the supported end and the energized region. In this embodiment, tuning cavities 313, 318 are disposed between the supported ends 311, 316 and the energized regions 312, 317. However, in other embodiments, the tuning cavities 313, 318 may not exist. As shown in FIG. 3B, a plurality of feedthrough connections 351 are disposed in the PCB 350 and serve to electrically connect the supported end of the prongs to the base 301. In this way, the supported ends 311, 316 of the prongs 310, 315 is at the same electrical potential as the base 301. Bores may be disposed in the base 301 allowing the passage of center conductors 361 from each respective feed port 360 to the PCB 350. Traces 352 are disposed within the PCB 350 and serve to electrically connect each of the center conductors 361 to a respective energization region. In this particular embodiment, the traces 352 are not shielded. The term "traces" is used to denote both traditional PCB connections, as well as electrical, electromagnetic and RF signals.

Figure 4A:
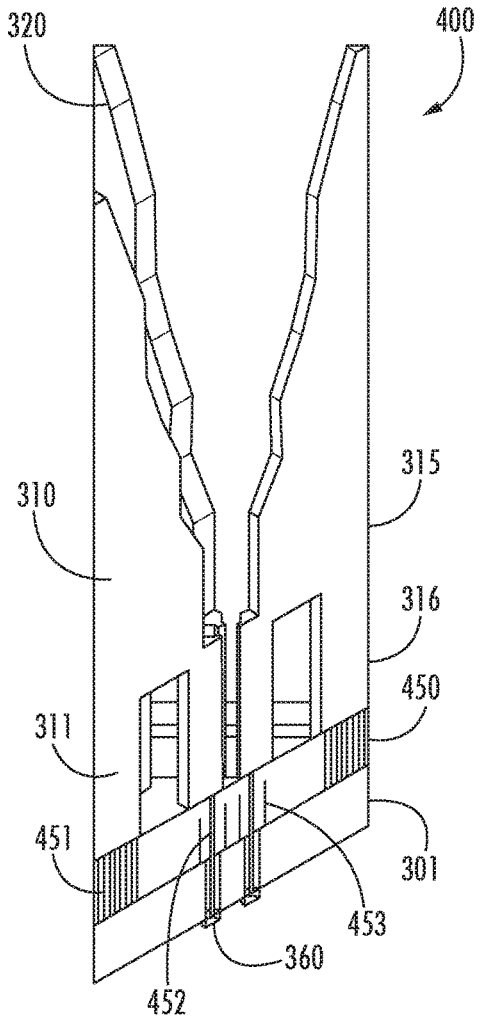
FIG. 4A shows a perspective view of a coincident phase centered antenna that uses a printed circuit board according to another embodiment.
Figure 4B:
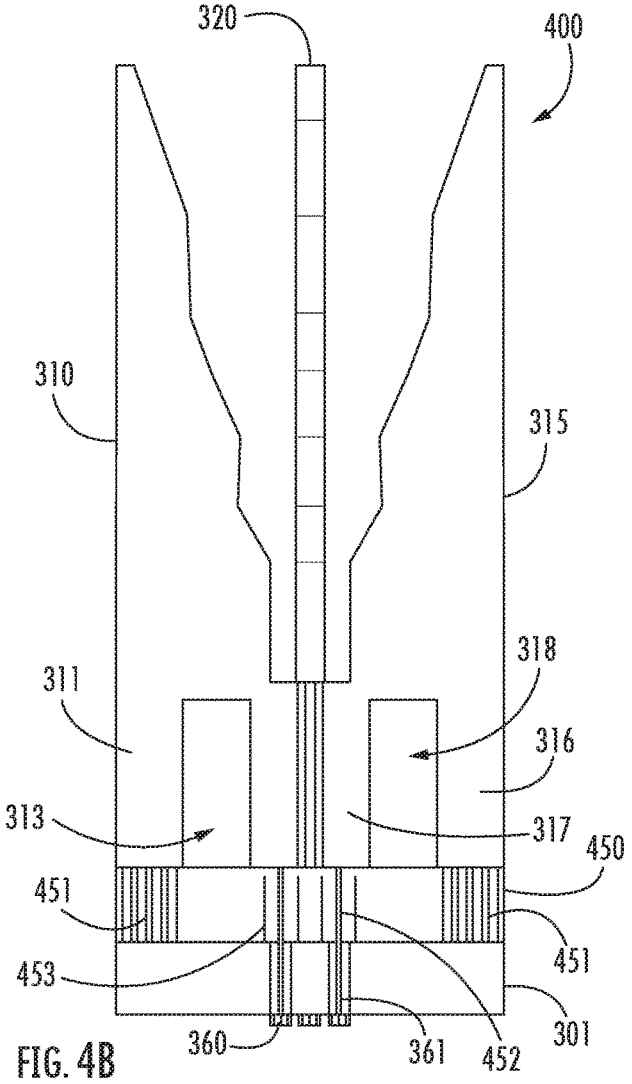
FIG. 4B shows a cross-section of the CPC antenna of FIG. 4A.

However, FIGS. 4A-4B show the embodiment of FIGS. 3A-3B where grounding vias are used. Components that are the same as in FIGS. 3A-3B have been identical reference designators. In this embodiment, a plurality of feedthrough connections 451 are disposed in the PCB 450 and serve to electrically connect the supported end of the prongs to the base 301. In this way, the supported ends 311, 316 of the prongs 310, 315 is at the same electrical potential as the base 301. Traces 452 serve to electrically connect each of the center conductors 361 to a respective energization region. Traces 452 may be sleeved with conductive material or quasi-sleeved with a series of conductive grounding vias 453 which are electrically connected to the ground layer. The conductive material or these grounding vias 453 are in communication with the base 301, but are not in electrical contact with the energization regions. These grounding vias 453 are used to approximate a solid coaxial cable. This maintains the transmission line characteristic impedance at the desired value.

Figure 5A:
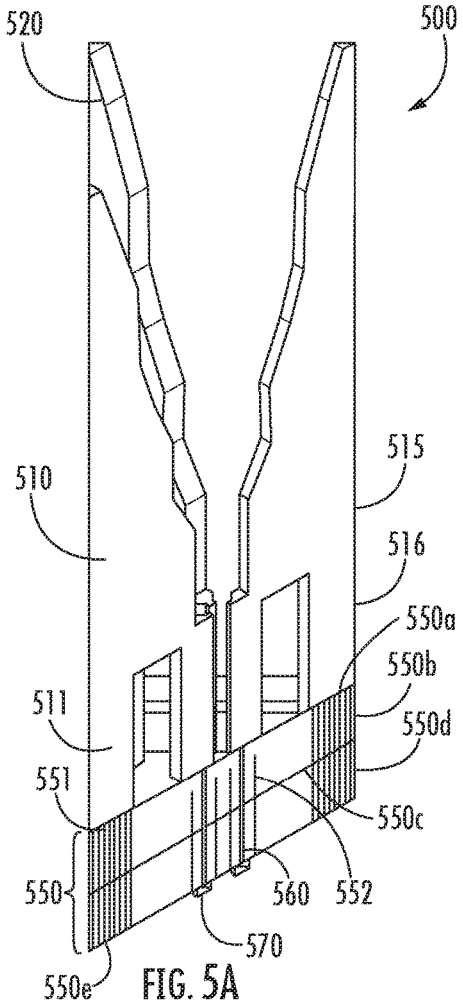
FIG. 5A shows a perspective view of a coincident phase centered antenna that uses a multi-layer printed circuit board according to one embodiment.
Figure 5B:
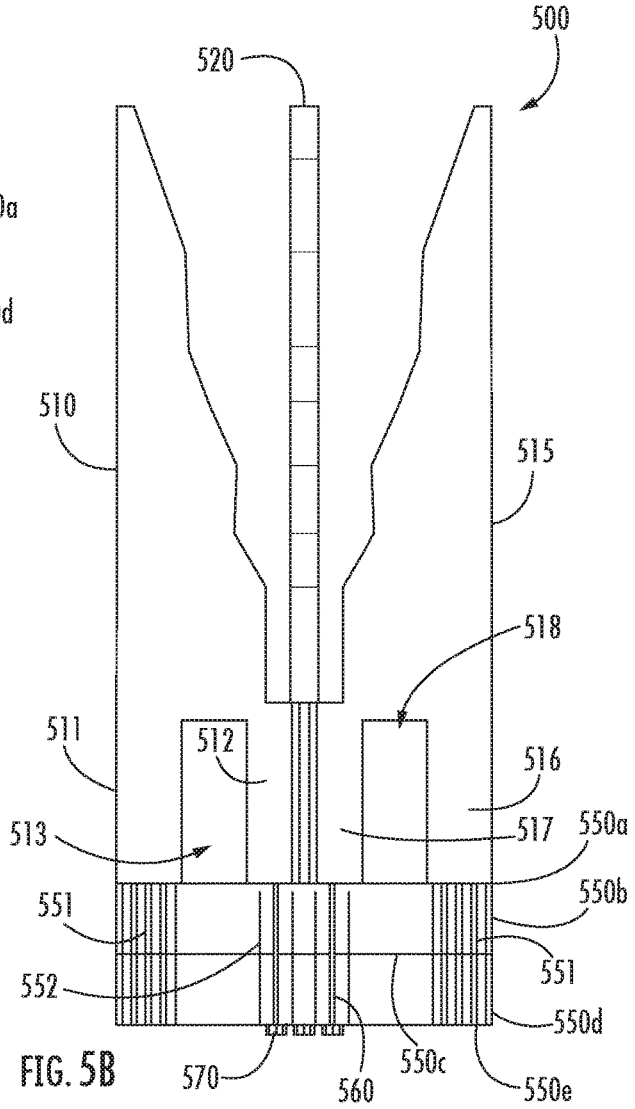
FIG. 5B shows a cross-section of the CPC antenna of FIG. 5A.

In another embodiment, a metal base is not utilized. Rather, the prongs rest atop a multiple layer PCB, that provides the electrical connections to the energization regions as well as the necessary grounding. Specifically, the bottom metal layer of the PCB becomes the region where external electrical conductivity is achieved. FIGS. 5A-5B show one such embodiment.

FIGS. 5A-5B show a CPC antenna 500 that utilizes a multi-layer PCB 550. The multi-layer PCB 550 has at least a top metal layer 550*a* and a bottom metal layer 550*e*, where the bottom metal layer 550*e* is disposed beneath the top metal layer 550*a*. A ground layer 550*c* may be disposed between the top metal layer 550*a* and the bottom metal layer 550*e*. A first dielectric layer 550*b* is disposed between the top metal layer 550*a* and the ground layer 550*c*. A second dielectric layer 550*d* is disposed between the ground layer 550*c* and the bottom metal layer 550*e*.

The prongs are disposed on the top metal layer 550*a*. Additionally, one or more stripline layers may be disposed in the PCB 550. For example, a stripline layer may be disposed within the first dielectric layer 550*b* and a second stripline layer may be disposed within the second dielectric layer 550*d*. When stripline layers are included, additional dielectric layers are also added. For example, if there are five metal layers (i.e. top metal layer 550*a*, bottom metal layer 550*e*, ground layer 550*c* and two stripline layers), there will be four dielectric layers; one dielectric layer between each pair of adjacent metal layers.

In certain embodiments, some or both of these stripline layers may not be included.

FIGS. 5A-5B show two horizontally polarized prongs 510, 515 and one vertically polarized prong 520. The second vertically polarized prong is not shown in the figures. Each prong has two parts; the supported end distal from the vertical gap, such as supported ends 511, 516 and the energized region, proximal to the vertical gap, such as energized regions 512, 517. In this embodiment, the supported end and the energized region both rest on the top metal layer 550*a* of the PCB 550. The support end and the energized region are bonded or mechanically affixed to the top metal layer 550*a* of the PCB 550.

The top metal layer 550*a* of the PCB 550 has a pattern formed in the geometry of the 3D structure base that forms the CPC antenna footprint. This pattern allows electrical connections to the energized regions 512, 517 as well as the necessary grounding for supported ends 511, 516 through the bonding material. The metal pattern will be disposed under the supported ends of the prongs, but may not be disposed beneath the energized regions 512, 517 and open tuning cavity regions 513 and 518.

In addition, each signal via or trace includes a via pad. This via pad is embedded into the footprint geometry, although may not be fully visible.

Electrical signals pass through the PCB 550, at the supported end and the energized region. In this embodiment, open tuning cavity regions 513, 518 are disposed between the supported ends 511, 516 and the energized regions 512, 517. However, in other embodiments, the open tuning cavity regions 513, 518 may not exist. As shown in FIG. 5B, a plurality of feedthrough connections 551 are disposed in the PCB 550 and serve to electrically connect the supported end of the prongs to the ground layer 550*c*. In certain embodiments, the feedthrough connections 551 may extend from the top metal layer 550*a* all the way to the bottom metal layer 550*e*. In this way, the supported end of the prongs is at the same electrical potential as the ground layer 550*c* and bottom metal layer 550*e*. The ground layer 550*c* may be electrically connected to coaxial connectors 570 disposed on the bottom of the PCB 550. This may be achieved by having the feedthrough connections 551 extend all the way to the bottom metal layer 550*e*, by having other vias connect the ground layer 550*c* to the bottom metal layer 550*e*, or by having the ground layer 550*c* in electrical contact with the shorting vias 552. The outer sleeve of the coaxial connector is in electrical communication with the ground layer 650*c* while the center conductor of the coaxial connector 570 is in communication with trace 560. Openings may be disposed in the ground layer 550*c* to allow the passage of traces 560 from the bottom metal layer 550*e* of the PCB 550 to the top metal layer 550*a* of the PCB 550. Traces 560 disposed within the PCB 550 serve to electrically connect each of four contact points on the bottom metal layer 550*e* of the PCB 550 to a respective energization region. The term "traces" is used to denote both traditional PCB connections, as well as electrical, electromagnetic and RF signals. In this particular embodiment, the traces 560 are sleeved with conductive material or quasi-sleeved with a series of conductive shorting vias 552, which are electrically connected to the ground layer 550*c*. In certain embodiments, the shorting vias 552 may extend from the top metal layer 550*a* all the way to the bottom metal layer 550*e*.

Figure 6:
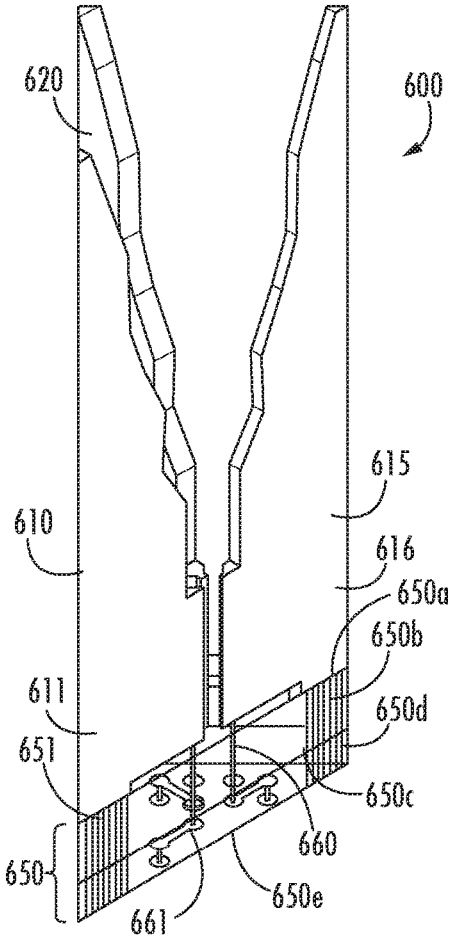
FIG. 6 shows a perspective view of a coincident phase centered antenna that uses a multi-layer printed circuit board according to another embodiment.

FIG. 6 shows another embodiment of a CPC antenna 600 that utilizes a multi-layer PCB 650. The multi-layer PCB 650 has at least a top metal layer 650*a* and a bottom metal layer 650*e*, where the bottom metal layer 650*e* is disposed beneath the top metal layer 650*a*. A ground layer 650*c* may be disposed between the top metal layer 650*a* and the bottom metal layer 650*e*. A first dielectric layer 650*b* is disposed between the top metal layer 650*a* and the ground layer 650*c*. A second dielectric layer 650*d* is disposed between the ground layer 650*c* and the bottom metal layer 650*e*.

Additionally, one or more stripline layers may be disposed in the PCB 650. For example, a stripline layer may be disposed within the first dielectric layer 650*b* and a second stripline layer may be disposed within the second dielectric layer 650*d*. When stripline layers are included, additional dielectric layers are also added. For example, if there are five metal layers (i.e. top metal layer 650*a*, bottom metal layer 650*e*, ground layer 650*c* and two stripline layers), there will be four dielectric layers; one dielectric layer between each pair of adjacent metal layers.

The prongs are disposed on the top metal layer 650*a*. FIG. 6 shows two horizontally polarized prongs 610, 615 and one vertically polarized prong 620. The second vertically polarized prong is not shown in the figure. Each prong has two parts; the supported end distal from the vertical gap, such as supported ends 611, 616 and the energized region, proximal to the vertical gap, such as energized regions 612, 617. In this embodiment, the supported end and the energized region both rest on the top metal layer 650*a* of the PCB 650. The support end and the energized region are bonded or mechanically affixed to the top metal layer 650*a* of the PCB 650.

The top metal layer 650*a* of the PCB 650 has a pattern formed in the geometry of the 3D structure base that forms the CPC antenna footprint. This pattern allows electrical connections to the energization regions at trace 660 as well as the necessary grounding regions, through the bonding material. The metal pattern will be disposed under the base of the prongs, but may not be disposed between the energization regions at the vertical gap.

In addition, each signal via or trace 660 includes a via pad. This via pad is embedded into the footprint geometry, although may not be fully visible.

Electrical signals pass through the PCB 650 at the support end and the energized region. In this embodiment, the tuning cavity is disposed within the PCB 650 and there is no visible tuning cavity. A plurality of feedthrough connections 651 are disposed in the PCB 650 and serve to electrically connect the supported end of the prongs to the ground layer 650*c*. In certain embodiments, the feedthrough connections 651 extend from the top metal layer 650*a* all the way to the bottom metal layer 650*e*. In this way, the supported end of the prongs is at the same electrical potential as the ground layer 650*c* and optionally bottom metal layer 650*e*. The ground layer 650*c* may be electrically connected to coaxial connectors (not shown) disposed on the bottom of the PCB 650 This may be achieved by having the feedthrough connections 651 extend all the way to the bottom metal layer 650*e*, by having other vias connect the ground layer 650*c* to the bottom metal layer 650*e*, or by another mechanism. Openings may be disposed in the ground layer 650*c* to allow the passage of traces 660 from the bottom metal layer 650*e* of the PCB 650 to the top metal layer 650*a* of the PCB 650. Traces 660 disposed within the PCB 650 serve to electrically connect each of four energization regions. The term "traces" is used to denote both traditional PCB connections, as well as electrical, electromagnetic and RF signals. Traces 660 may be routed in a horizontal direction as shown in the figure. This may be done by disposing a horizontal stripline trace 661 on a stripline layer disposed within the PCB 650. As described above, a stripline layer may be disposed within the first dielectric layer 650*b*. In another embodiment, which is shown in FIG. 6, the horizontal traces 661 are disposed on a second stripline layer disposed within the second dielectric layer 650*d*. The horizontal traces 661 is used to spatially separate the four traces 660 from one another to simplify connection to external connections. In some embodiments, the horizontal traces 661 are all exactly the same length so as not to introduce any polarization distortion. Though not shown, in some embodiments, the traces 660 are sleeved with conductive material or quasi-sleeved with a series of conductive shorting vias, which are electrically connected to the ground layer 650*c*.

Figure 7:
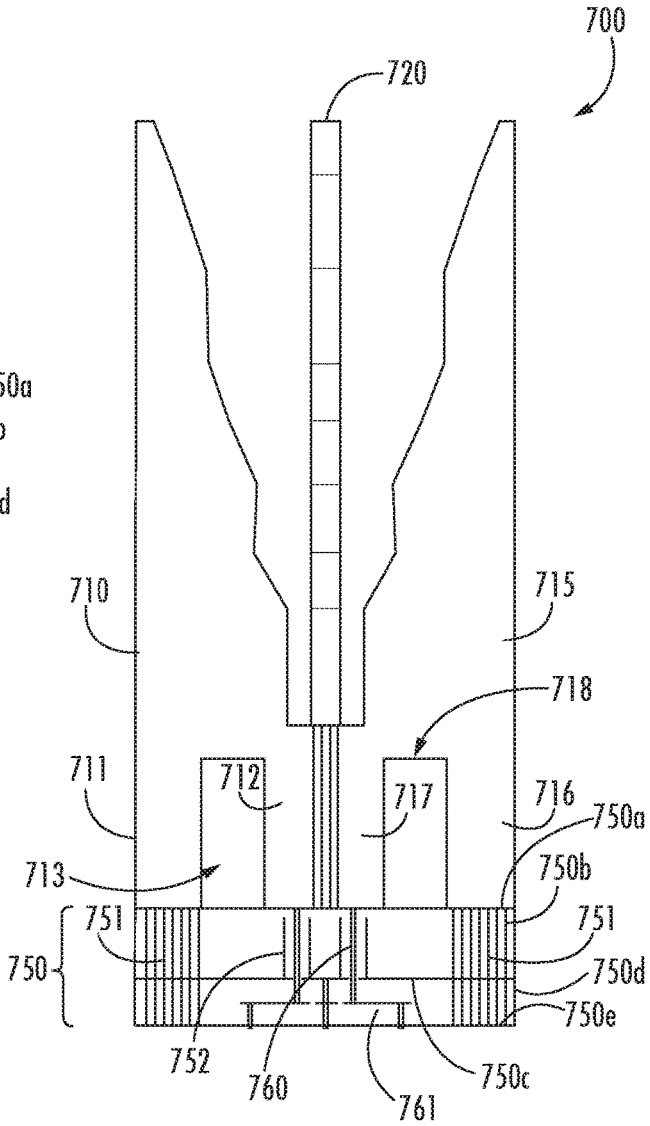
FIG. 7 shows a cross-section of a CPC antenna that uses a multi-layer printed circuit board according to another embodiment.

FIG. 7 shows another embodiment. The multi-layer PCB 750 has at least a top metal layer 750*a* and a bottom metal layer 750*e*, where the bottom metal layer 750*e* is disposed beneath the top metal layer 750*a*. A ground layer 750*c* may be disposed between the top metal layer 750*a* and the bottom metal layer 750*e*. A first dielectric layer 750*b* is disposed between the top metal layer 750*a* and the ground layer 750*c*. A second dielectric layer 750*d* is disposed between the ground layer 750*c* and the bottom metal layer 750*e*.

The prongs are disposed on the top metal layer 750*a*. FIG. 7 shows two horizontally polarized prongs 710, 715 and one vertically polarized prong 720. The second vertically polarized prong is not shown in the figure. Each prong has two parts; the supported end distal from the vertical gap, such as supported ends 711, 716 and the energized region, proximal to the vertical gap, such as energized regions 712, 717. In this embodiment, the supported end and the energized region both rest on the top metal layer 750*a* of the PCB 750. The support end and the energized region are bonded or mechanically affixed to the top metal layer 750*a* of the PCB 750.

The top metal layer 750*a* has a metal pattern formed in the geometry of the 3D structure that forms the CPC antenna footprint. For example, the metal pattern will be disposed under the supported ends of the prongs, but may not be disposed between the energization regions. Each via needs a via pad. This via pad is embedded into the footprint geometry, although may not be fully visible.

Electrical signals pass through the PCB 750, at the support end and the energized region. In this embodiment, tuning cavities 713, 718 are disposed between the supported ends 711, 716 and the energized regions 712, 717. However, in other embodiments, like the one shown in FIG. 6, the tuning cavities 713, 718 may be disposed within the PCB using various techniques. As shown in FIG. 7, a plurality of feedthrough connections 751 are disposed in the PCB 750 and serve to electrically connect the supported end of the prongs to the ground layer 750*c* and optionally bottom metal layer 750*e*. In this way, the supported end of the prongs is at the same electrical potential as the ground layer 750*c* and optionally bottom metal layer 750*e*. The ground layer 750*c* is electrically connected to coaxial connectors (not shown) disposed on the bottom of the PCB 750. This may be achieved by having the feedthrough connections 751 extend all the way to the bottom metal layer 750*e*, by having other vias connect the ground layer 750*c* to the bottom metal layer 750*e*, or by another mechanism. Openings may be disposed in the ground layer 750*c* to allow the passage of traces 760 from the bottom metal layer 750*e* of the PCB 750 to the top metal layer 750*a* of the PCB 750. Traces 760 disposed within the PCB 750 serve to electrically connect each of four energization regions. The term "traces" is used to denote both traditional PCB connections, as well as electrical, electromagnetic and RF signals. In this particular embodiment, the traces 760 are sleeved with conductive material or quasi-sleeved with a series of conductive shorting vias 752 which are electrically connected to the ground layer 750*c* and optionally bottom metal layer 750*e*. Traces 760 may be routed in a horizontal direction as shown in the figure. This may be done by disposing a horizontal stripline trace 761 on a stripline layer disposed within the PCB 750. As described above, a stripline layer may be disposed within the first dielectric layer 750*b*. In another embodiment, shown in FIG. 7, the horizontal traces 761 are disposed on a second stripline layer disposed within the second dielectric layer 750*d*. The horizontal traces 761 is used to spatially separate the four traces 760 from one another to simplify connection to external connections. In some embodiments, the horizontal traces 761 are all exactly the same length so as not to introduce any polarization distortion.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A coincident phase centered (CPC) antenna comprising:

a base; wherein the base comprises four bores that pass from a bottom surface of the base to a top surface of the base;

two horizontally polarized prongs extending upward from the top surface of the base and defining a first vertical gap therebetween;

two vertically polarized prongs extending upward from the top surface of the base and defining a second vertical gap therebetween, wherein a midline of the first vertical gap is coincident with the midline of the second vertical gap;

wherein each prong has a supported end that is attached to the base and a free end, separated from the base, that disposed proximate to the midline, wherein a gap exists between a bottom surface of the free end and the base;

four feed ports disposed on the bottom surface of the base; and four electrical feeds that each pass through a respective bore and have a distal end that is electrically connected to the free end of one of the prongs and a proximal end that is electrically connected to a respective feed port, wherein each of the electrical feeds extend across the gap.

2. The CPC antenna of claim 1, wherein the base comprises a metal pedestal that extends upward from the base such that each of the free ends are disposed directly above the metal pedestal, wherein a horizontal gap is formed between an upper surface of the metal pedestal and lower portions of each of the free ends, and wherein the four bores pass through the metal pedestal.

3. The CPC antenna of claim 1, wherein the electrical feeds comprise coaxial transmission lines, having a center conductor.

4. The CPC antenna of claim 3, wherein a dielectric material is disposed between the bore and the center conductor.

5. The CPC antenna of claim 1, wherein a tuning cavity is disposed between the free end of each prong and the supported end of the respective prong.

6. The CPC antenna of claim 1, wherein the base comprises four metal sleeves that extends upward from the base such that each of the free ends are disposed directly above a respective metal sleeve, wherein a horizontal gap is formed between an upper surface of the metal sleeves and lower portions of each of the free ends, and wherein the four bores each pass through a respective metal sleeve.

7. A coincident phase centered (CPC) antenna comprising:

a base; wherein the base comprises four bores that pass from a bottom surface of the base to a top surface of the base;

a printed circuit board (PCB) disposed on the top surface of the base, the printed circuit board having a top surface and a bottom surface, wherein the bottom surface rests on the top surface of the base;

two horizontally polarized prongs extending upward from the top surface of the PCB and defining a first vertical gap therebetween;

two vertically polarized prongs extending upward from the top surface of the PCB and defining a second vertical gap therebetween, wherein a midline of the first vertical gap is coincident with the midline of the second vertical gap;

wherein each prong has a supported end that is mechanically connected to the top surface of the PCB and electrically connected to the base by feedthrough connections that extend from the top surface of the PCB to the bottom surface of the PCB, and a free end that is disposed proximate to the midline and electrically connected to a respective trace in the PCB;

four feed ports disposed on the bottom surface of the base; and four electrical feeds that each pass through a respective bore and have a distal end that is electrically connected to the respective trace in the PCB and a proximal end that is electrically connected to a respective feed port.

8. The CPC antenna of claim 7, wherein the electrical feeds comprise coaxial transmission lines, having a center conductor.

9. The CPC antenna of claim 8, wherein a dielectric material is disposed between the bore and the center conductor.

10. The CPC antenna of claim 7, wherein a tuning cavity is disposed between the free end of each prong and the supported end of the respective prong.

11. The CPC antenna of claim 7, wherein a conductive sleeve or grounding vias are disposed around each respective trace, and the conductive sleeve or grounding vias are in electrical communication with the base.

12. The CPC antenna of claim 7, wherein the base is metal.

13. The CPC antenna of claim 7, wherein the prongs are metal.

14. A coincident phase centered (CPC) antenna comprising:

a multi-layer printed circuit board (PCB);

two horizontally polarized prongs extending upward from a top surface of the PCB and defining a first vertical gap therebetween;

two vertically polarized prongs extending upward from the top surface of the PCB and defining a second vertical gap therebetween, wherein a midline of the first vertical gap is coincident with the midline of the second vertical gap;

wherein each prong has a supported end that is mechanically connected to the top surface of the PCB and electrically connected to ground by feedthrough connections and a free end that is disposed proximate to the midline and electrically connected to a respective trace in the PCB;

wherein each respective trace extends to a bottom layer of the PCB.

15. The CPC antenna of claim 14, wherein the PCB comprises a top metal layer, a ground layer, a bottom metal layer, a first dielectric layer disposed between the top metal layer and the ground layer, and a second dielectric layer disposed between the ground layer and the bottom metal layer, wherein a metal pattern formed in a geometry of the 3D structure that forms a footprint of the CPC antenna is disposed on the top metal layer.

16. The CPC antenna of claim 15, wherein the respective traces are sleeved with conductive material or quasi-sleeved with a series of conductive shorting vias which are electrically connected to the ground layer.

17. The CPC antenna of claim 15, wherein four horizontal striplines are disposed between the ground layer and the bottom metal layer, and are used to spatially separate the four traces from one another on the bottom metal layer.

18. The CPC antenna of claim 15, wherein four horizontal striplines are disposed between the top metal layer and the ground layer, and are used to spatially separate the four traces from one another on the bottom metal layer.

19. The CPC antenna of claim 14, wherein the prongs are metal.

20. The CPC antenna of claim 14, wherein the PCB comprises a top metal layer and a ground layer and wherein the feedthrough connections extend from the top metal layer to the ground layer.

* * * * *